US012790667B2

(12) United States Patent
Liang et al.

(10) Patent No.: US 12,790,667 B2
(45) Date of Patent: Nov. 10, 2026

(54) METHOD FOR PREPARING CEMENTED CARBIDE WITH DUAL GRADIENTS BY GRAPHENE-INDUCED Co MIGRATION

(71) Applicant: Guizhou University, Guiyang City (CN)

(72) Inventors: Yilong Liang, Guiyang City (CN); Guanyu He, Guiyang City (CN)

(73) Assignee: Guizhou University, Guiyang City (CN)

( * ) Notice: Subject to any disclaimer, the term of this patent is extended or adjusted under 35 U.S.C. 154(b) by 341 days.

(21) Appl. No.: 18/764,506

(22) Filed: Jul. 5, 2024

(65) Prior Publication Data

US 2025/0011901 A1 Jan. 9, 2025

(30) Foreign Application Priority Data

Jul. 5, 2023 (CN) ..... 202310819623.0

(51) Int. Cl.

| | |
|---|---|
| ***C22C 1/051*** | (2023.01) |
| ***B22F 1/14*** | (2022.01) |
| ***C22C 29/00*** | (2006.01) |
| ***C22C 29/08*** | (2006.01) |

(52) U.S. Cl.

CPC ..... *C22C 1/051* (2013.01); *B22F 1/14* (2022.01); *C22C 29/005* (2013.01); *C22C 29/08* (2013.01); *B22F 2201/20* (2013.01); *B22F 2301/15* (2013.01); *B22F 2302/10* (2013.01); *B22F 2304/10* (2013.01)

(58) Field of Classification Search

CPC ..... C22C 1/051; C22C 29/005; C22C 29/08; C22C 26/00; C22C 29/067; B22F 1/14; B22F 2201/20; B22F 2301/15; B22F 2302/10; B22F 2304/10; B22F 3/14; B22F 3/24; B22F 2003/242; B22F 3/26

USPC ..... 419/6

See application file for complete search history.

(56) References Cited

FOREIGN PATENT DOCUMENTS

| | | | | |
|---|---|---|---|---|
| CN | 107058842 A | * | 8/2017 | ..... C22C 29/067 |
| CN | 107460391 A | * | 12/2017 | ..... C22C 29/08 |
| JP | S62226889 A | | 10/1987 | |

OTHER PUBLICATIONS

CN107058842A Translation (Year: 2017).*
CN107460391A Translation (Year: 2017).*
Office Action issued May 30, 2025, in corresponding Chinese Patent Application No. 202310819623.0 (with English translation), 10 pages.

* cited by examiner

*Primary Examiner* — Danielle M. Carda
(74) *Attorney, Agent, or Firm* — Element IP, PLC

(57) ABSTRACT

Disclosed is a method for preparing a cemented carbide with dual gradients by graphene-induced Co migration. The method includes: subjecting a WC—Co cemented carbide powder to first vacuum hot-pressed sintering to obtain a prefabricated WC—Co cemented carbide; subjecting the prefabricated WC—Co cemented carbide to first ultrasonic treatment and second ultrasonic treatment in sequence to obtain a graphene/WC—Co cemented carbide, wherein the first ultrasonic treatment is conducted in anhydrous ethanol, and the second ultrasonic treatment is conducted in a graphene dispersion; and subjecting the graphene/WC—Co cemented carbide to second vacuum hot-pressed sintering to obtain the WC cemented carbide with dual gradients.

9 Claims, 13 Drawing Sheets

METHOD FOR PREPARING CEMENTED CARBIDE WITH DUAL GRADIENTS BY GRAPHENE-INDUCED Co MIGRATION

CROSS-REFERENCE TO RELATED APPLICATION

This patent application claims the benefit and priority of Chinese Patent Application No. 202310819623.0, entitled "Method for preparing cemented carbide with dual gradients by graphene-induced Co migration" filed on Jul. 5, 2023, the disclosure of which is incorporated by reference herein in its entirety as part of the present application.

TECHNICAL FIELD

The present disclosure relates to the technical field of gradient cemented carbide preparation, and in particular to a method for preparing a cemented carbide with dual gradients by graphene-induced Co migration.

BACKGROUND

Cemented carbide is generally composed of a hard phase and a binder phase. The hardness and wear resistance of the cemented carbide are mainly provided by the hard phase, while the toughness is generally attributed to plastic deformation energy absorption of the binder phase. Therefore, it is impossible to improve the hardness and wear resistance while improving the toughness by increasing a hard-phase content. In order to solve a contradiction between the hardness, wear resistance, and toughness of cemented carbide and to improve a service life of the cemented carbide, gradient cemented carbide is developed. The gradient cemented carbide overcomes the shortcomings of uniformly-structured cemented carbide, and introduces or forms a gradient distribution of the composition or microstructure, such that the gradient cemented carbide achieves higher hardness, greater wear resistance, and meanwhile higher toughness.

At present, there are three main methods for forming a gradient cemented carbide with a cobalt-poor surface layer. A first method is to prepare a cemented carbide with dual phases, in which, an overall carbon-deficient phase is prefabricated to allow pre-pressing, followed by high-temperature sintering in a graphite powder. The gradient cemented carbide prepared by the first method has a three-layer structure, in which a cobalt-poor surface layer provides high hardness and wear resistance, while an intermediate cobalt-rich layer provides high toughness. However, a carbon-deficient phase in the core does not undergo phase transformation after the high-temperature sintering, thus resulting in insufficient toughness of the core, and thereby adversely affecting an overall performance of the cemented carbide. A second method is to conduct secondary carburizing heat treatment on a sintered homogeneous cemented carbide in a carburizing atmosphere, such that the cobalt phase migrates inward in the action of a liquid phase migration force. However, a long-term secondary heat treatment may cause abnormal growth of tungsten carbide grains, and carbon is also easy to enrich in the surface area to form graphite, making mechanical properties of the surface area lower than those of the core. A third method is a prefabricated gradient method, which achieves a functional gradient after sintering by prefabricating WC grain size, carbon content, and cobalt content. The biggest defect of this method is that the migration of liquid cobalt could lead to the homogenization of cobalt, making it impossible to maintain a prefabricated cobalt gradient after liquid-phase sintering.

In view of this, it has become an urgent technical problem to be solved in this field to make WC cemented carbide have high hardness, great wear resistance, and meanwhile high toughness.

SUMMARY

An object of the present disclosure is to provide a method for preparing a cemented carbide with dual gradients by graphene-induced Co migration. The cemented carbide with dual gradients, i.e., the WC cemented carbide with graphene and cobalt gradients reversed with each other, prepared by the method has high hardness, great wear resistance, and meanwhile high toughness.

To achieve the above object, the present disclosure provides the following technical solutions:

The present disclosure provides a method for preparing a WC cemented carbide with graphene and cobalt gradients reversed with each other, including the following steps:

(1) subjecting a WC—Co cemented carbide powder to first vacuum hot-pressed sintering to obtain a prefabricated WC—Co cemented carbide;

(2) subjecting the prefabricated WC—Co cemented carbide obtained in step (1) to first ultrasonic treatment and second ultrasonic treatment in sequence to obtain a graphene/WC—Co cemented carbide, wherein the first ultrasonic treatment is conducted in anhydrous ethanol, and the second ultrasonic treatment is conducted in a graphene dispersion; and (3) subjecting the graphene/WC—Co cemented carbide obtained in step (2) to second vacuum hot-pressed sintering to obtain the WC cemented carbide with graphene and cobalt gradients reversed with each other.

In some embodiments, in step (2), the first ultrasonic treatment is conducted at an ultrasonic frequency of 20 kHz to 60 kHz and an ultrasonic power of 500 W to 1,500 W for 1 min to 90 min.

In some embodiments, in step (2), the second ultrasonic treatment is conducted at an ultrasonic frequency of 20 kHz to 60 kHz and an ultrasonic power of 500 W to 1,500 W for 30 s to 60 min.

In some embodiments, in step (2), the graphene dispersion has a graphene concentration of 0.1 g/mL to 1 g/mL.

In some embodiments, in step (1), the first vacuum hot-pressed sintering is conducted at a temperature of 500° C. to 1,200° C. and a pressure of 5 MPa to 40 MPa.

In some embodiments, in step (1), a mass percentage of Co in the WC—Co cemented carbide powder ranges from 4% to 20%.

In some embodiments, in step (1), the WC—Co cemented carbide powder has a particle size of 0.1 μm to 20 μm.

In some embodiments, in step (3), the second vacuum hot-pressed sintering is conducted at a temperature of 1,300° C. to 1,500° C. and a pressure of 5 MPa to 40 MPa.

The present disclosure further provides a WC cemented carbide with graphene and cobalt gradients reversed with each other prepared by the method as described in above technical solutions.

In some embodiments, the WC cemented carbide with graphene and cobalt gradients reversed with each other includes a surface layer, an intermediate layer, and a core in sequence from outside to inside, wherein in the WC cemented carbide with graphene and cobalt gradients reversed with each other, graphene is gradiently distributed with a gradually decreased content from the surface layer to the intermediate layer; in the WC cemented carbide with graphene and cobalt gradients reversed with each other, Co is gradiently distributed with a gradually increased content from the surface layer to the intermediate layer; and the core is a homogeneous WC—Co cemented carbide.

The present disclosure provides a method for preparing a WC cemented carbide with graphene and cobalt gradients reversed with each other, including the following steps: subjecting a WC—Co cemented carbide powder to first vacuum hot-pressed sintering to obtain a prefabricated WC—Co cemented carbide; subjecting the prefabricated WC—Co cemented carbide to first ultrasonic treatment and second ultrasonic treatment in sequence to obtain a graphene/WC—Co cemented carbide, wherein the first ultrasonic treatment is conducted in anhydrous ethanol; and the second ultrasonic treatment is conducted in a graphene dispersion; and subjecting the graphene/WC—Co cemented carbide to second vacuum hot-pressed sintering to obtain the WC cemented carbide with graphene and cobalt gradients reversed with each other. In the present disclosure, the first vacuum sintering is conducted to obtain a prefabricated WC—Co cemented carbide that has not been sintered to be dense, and there are a large number of gaps in its structure. The first ultrasonic treatment is conducted in anhydrous ethanol, and surface particles that have not been sintered to be dense could fall off from the matrix in the action of a shear force generated by bubble bursting by virtue of ultrasound, thereby forming more pores on the surface. The second ultrasonic treatment is conducted in the graphene dispersion, such that the surface layer of the WC—Co cemented carbide, which has a large number of pores, adsorbs graphene. During the second vacuum hot-pressed sintering, by utilizing a desirable thermal conductivity of the graphene in the pores, Co is quickly melted, then migrates from the surface layer to the intermediate layer, thereby forming a WC cemented carbide with a cobalt gradient distribution in which the surface layer is poor in Co while the intermediate layer is rich in Co. Moreover, since the shear force generated by the bubble bursting during the second ultrasonic treatment is transmitted from the outside to the inside, the force on the surface layer is strong while the force on the intermediate layer is weak, and there is no obvious effect on the deeper in the structure, i.e., the core. As a result, the amount of pores formed in the surface layer is higher than that in the intermediate layer, such that a graphene content adsorbed by the pores in the surface layer is higher than that in the intermediate layer, thereby forming a gradient distribution in which the graphene content gradually decreases from the surface layer to the intermediate layer. While using graphene to toughen, the graphene in the surface layer is also to quickly and fully induce Co to migrate inward, thereby forming a gradient distribution in which a Co content gradually increases from the surface layer to the intermediate layer, thereby resulting in that the WC cemented carbide have high hardness, great wear resistance, and meanwhile high toughness.

The results of examples show that the WC cemented carbide with graphene and cobalt gradients reversed with each other prepared by the method according to the present disclosure has a hardness of 1,820-1,871 kgf/mm$^2$, a fracture toughness of 13.8-17.6 MPa·m$^{1/2}$, and a wear rate of $2.62\times10^{-6}$-$17.1\times10^{-6}$ mm$^3$/Nm in the surface layer; and a hardness of 1,365-1,367 kgf/mm$^2$, a fracture toughness of 11.6-12.1 MPa·m$^{1/2}$, and a wear rate of $39.06\times10^{-6}$-$39.45\times10^{-6}$ mm$^3$/Nm in the core. Compared with a homogeneous WC—Co cemented carbide in Comparative Example 1, the WC cemented carbide with graphene and cobalt gradients reversed with each other has the surface hardness increased by 34.9% to 38.7%, the surface fracture toughness increased by 15% to 46.6%, and the surface wear rate reduced by 57% to 93.4%; and meanwhile has equivalent core performance to that of Comparative Example 1, due to the core of both being the homogeneous WC-11%Co cemented carbide. This indicates that the WC cemented carbide with graphene and cobalt gradients reversed with each other prepared by the method has high hardness, great wear resistance, and meanwhile high toughness.

In addition, the method according to the present disclosure is simple and efficient, and does not form other undesirable defects during induced cobalt migration.

BRIEF DESCRIPTION OF THE DRAWINGS

FIG. 5A to FIG. 5F show an overall structure morphology, a locally enlarged microscopic appearance, and a corresponding local element distribution diagram of a cross-section of the WC cemented carbide with graphene and cobalt gradients reversed with each other prepared in Example 1 of the present disclosure, in which, FIG. 5A shows an SEM image of an overall structure of the WC cemented carbide with graphene and cobalt gradients reversed with each other; FIG. 5B shows a cobalt element distribution diagram corresponding to a local area of FIG. 5A, acquired by X-ray energy spectrometer; FIG. 5C and FIG. 5D show local enlarged SEM images of designated areas in FIG. 5A, respectively; FIG. 5E shows a cobalt element distribution diagram from the surface layer to the core, acquired by electron probe X-ray microscopic analyzer; and FIG. 5F shows a line-scanning image of the cobalt element from the surface layer to the core of FIG. 5E, acquired by electron probe X-ray microscopic analyzer.

FIG. 6A to FIG. 6D show an overall structure morphology, a locally enlarged microscopic appearance, and a corresponding local element distribution diagram of the WC cemented carbide with graphene and cobalt gradients reversed with each other prepared in Example 2 of the present disclosure, in which FIG. 6A shows an SEM image of an overall structure of the WC cemented carbide with graphene and cobalt gradients reversed with each other; FIG. 6B shows the cobalt element distribution corresponding to a local area of FIG. 6A; and FIG. 6C and FIG. 6D show local enlarged SEM images of designated areas in FIG. 6A, respectively.

FIG. 7A to FIG. 7D show an overall structure morphology, a locally enlarged microscopic appearance, and a corresponding local element distribution diagram of the homogeneous cemented carbide in Comparative Example 1 of the present disclosure, in which FIG. 7A shows an SEM image of an overall structure of the homogeneous cemented carbide; FIG. 7B shows the cobalt element distribution diagram corresponding to a local area of FIG. 7A and FIG. 7C and FIG. 7D show local enlarged SEM images of designated areas in FIG. 7A, respectively.

FIG. 9A and FIG. 9B show a gradient distribution of graphene from the surface layer to the core of the WC—Co cemented carbide prepared in Example 1, in which FIG. 9A shows an SEM image of a cross section of the WC—Co cemented carbide prepared in Example 1, the directional arrows therein indicating the presence of graphene; and FIG. 9B shows a carbon element distribution of the cross section of the WC—Co cemented carbide prepared in Example 1 by mapping of SEM with energy-dispersive X-ray spectroscopy, the directional arrows indicating the positions of graphene.

DETAILED DESCRIPTION OF THE EMBODIMENTS

Figure 1:
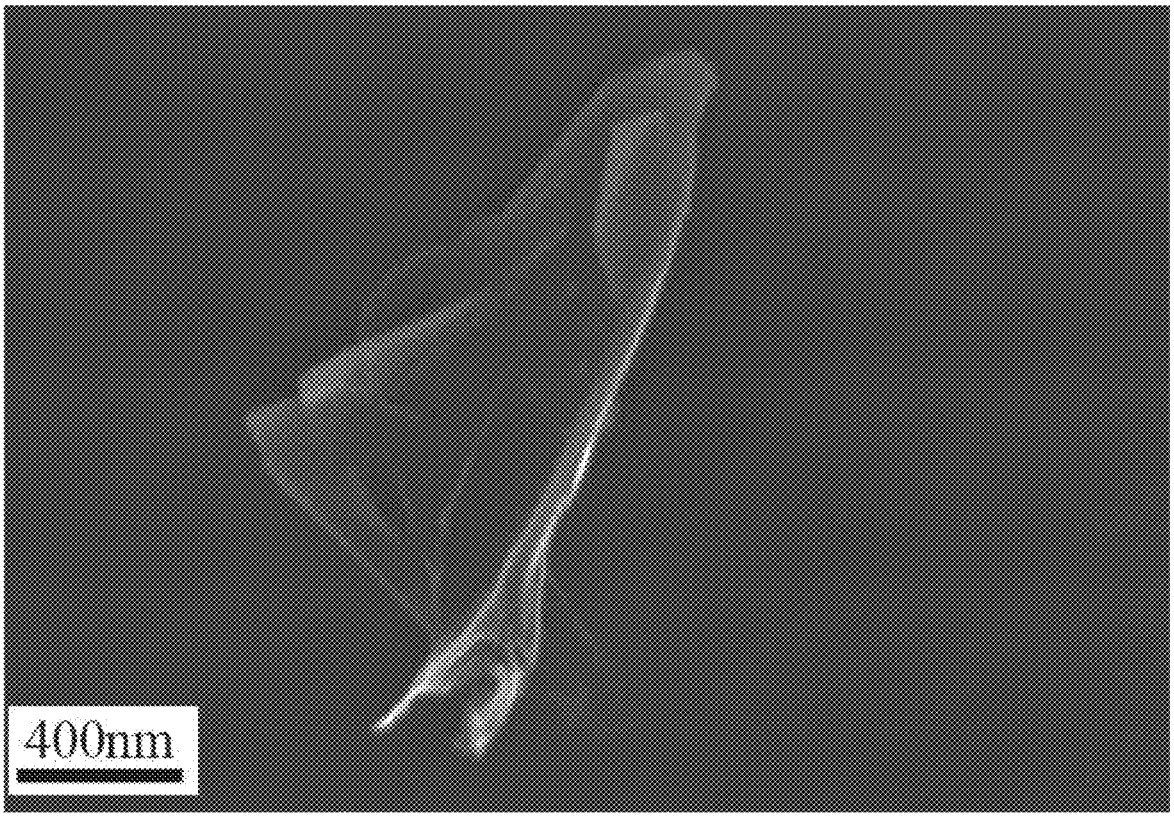
FIG. 1 shows a scanning electron microscopy (SEM) image of the graphene used in step (1) of Example 1 and Example 2 in the present disclosure.

The present disclosure provides a method for preparing a WC cemented carbide with graphene and cobalt gradients reversed with each other, including the following steps:

(1) subjecting a WC—Co cemented carbide powder to first vacuum hot-pressed sintering to obtain a prefabricated WC—Co cemented carbide;

(2) subjecting the prefabricated WC—Co cemented carbide obtained in step (1) to first ultrasonic treatment and second ultrasonic treatment in sequence to obtain a graphene/WC—Co cemented carbide, wherein the first ultrasonic treatment is conducted in anhydrous ethanol, and the second ultrasonic treatment is conducted in a graphene dispersion; and (3) subjecting the graphene/WC—Co cemented carbide obtained in step (2) to second vacuum hot-pressed sintering to obtain the WC cemented carbide with graphene and cobalt gradients reversed with each other.

In the present disclosure, unless otherwise specified, the "/" represent "compositing".

In the present disclosure, a WC—Co cemented carbide powder is subjected to first vacuum hot-pressed sintering to obtain a prefabricated WC—Co cemented carbide.

In some embodiments of the present disclosure, a mass percentage of Co in the WC—Co cemented carbide powder ranges from 4% to 20%, and preferably 6% to 18%, and more preferably 8% to 15%. By controlling the mass percentage of Co in the cemented carbide powder within the above range, Co could be used as a binder phase to improve the toughness of cemented carbide; and meanwhile it is also conducive to the migration of Co by the induction of graphene to form a suitable gradient distribution, thereby further enhancing the toughness of cemented carbide.

In some embodiments of the present disclosure, the WC—Co cemented carbide powder has a particle size of 0.1 μm to 20 μm, preferably 0.3 μm to 18 μm, and more preferably 0.5 μm to 15 μm. By controlling the particle size of the WC—Co cemented carbide powder within the above range, it is more conducive to obtaining appropriate pores, and allowing Co to migrate better and form a gradient distribution.

In some embodiments of the present disclosure, the first vacuum hot-pressed sintering is conducted at a temperature of 500° C. to 1,200° C., preferably 600° C. to 1,100° C., more preferably 700° C. to 1,000° C., and even more preferably 800° C. to 900° C. In some embodiments, the first vacuum hot-pressed sintering is conducted at a pressure of 5 MPa to 40 MPa, preferably 10 MPa to 30 MPa, and more preferably 15 MPa to 25 MPa. By controlling the parameters of the first hot-pressed sintering within the above range, the prefabricated WC—Co cemented carbide could have an unsintered dense structure with more pores.

In the present disclosure, the prefabricated WC—Co cemented carbide is subjected to first ultrasonic treatment and second ultrasonic treatment in sequence to obtain a graphene/WC—Co cemented carbide.

In the present disclosure, the first ultrasonic treatment is conducted in anhydrous ethanol. Through the first ultrasonic treatment in the anhydrous ethanol, more pores could be further formed in the unsintered dense structure, which is more conducive to the adsorption of graphene.

In some embodiments of the present disclosure, the first ultrasonic treatment is conducted for 1 min to 90 min, preferably 10 min to 80 min, and more preferably 20 min to 70 min. In some embodiments, the first ultrasonic treatment is conducted at an ultrasonic frequency of 20 kHz to 60 kHz, and preferably 25 kHz to 55 kHz. In some embodiments, the first ultrasonic treatment is conducted at an ultrasonic power of 500 W to 1,500 W, and preferably 600 W to 1,300 W. By controlling the parameters of the first ultrasonic treatment within the above range, it is more conducive to obtaining a porous WC—Co cemented carbide with appropriate porosity.

In the present disclosure, the second ultrasonic treatment is conducted in a graphene dispersion. The second ultrasonic treatment in the graphene dispersion could realize the adsorption of the graphene into the pores, and Co in the cemented carbide could be quickly melted and migrated by virtue of a desirable thermal conductivity of the graphene, thereby forming a gradient distribution of Co.

In some embodiments of the present disclosure, the graphene dispersion has a graphene concentration of 0.1 g/mL to 1 g/mL, preferably 0.2 g/mL to 0.9 g/mL, and more preferably 0.3 g/mL to 0.8 g/mL. By controlling the concentration of the graphene dispersion for the second ultrasonic treatment within the above range, it is more conducive to sufficient adsorption of graphene.

In some embodiments of the present disclosure, a solvent of the graphene dispersion is anhydrous ethanol.

In some embodiments of the present disclosure, the graphene dispersion further includes at least one of a surfactant and nano-tungsten carbide.

In some embodiments of the present disclosure, the surfactant is cetyltrimethylammonium bromide (CTAB) or polyvinylpyrrolidone (PVP). In some embodiments, a mass ratio of the surfactant to the graphene in the graphene dispersion ranges from 1:0.8 to 1:1.2, and preferably 1:1. The dispersibility of graphene could be further improved by adding a surfactant and controlling its amount within the above range.

In some embodiments of the present disclosure, a mass ratio of the nano-tungsten carbide to the graphene in the graphene dispersion ranges from 5:1 to 10:1, and preferably 10:1. In some embodiments, the nano-tungsten carbide has a particle size of 45 nm to 55 nm, preferably being 50 nm. By adding the nano-tungsten carbide and controlling its amount and particle size within the above ranges, the graphene could be bonded to the surface of nano-tungsten carbide, thereby further dispersing the graphene. In addition, the addition of the nano-tungsten carbide could further refine the grains and improve the hardness and wear resistance of the cemented carbide.

In some embodiments of the present disclosure, the graphene dispersion is prepared by ultrasonic dispersion. There is no special requirement for parameters of the ultrasonic dispersion, as long as a uniformly dispersed graphene dispersion could be obtained.

In some embodiments of the present disclosure, the second ultrasonic treatment is conducted for 30 s to 60 min, and preferably 1 min to 50 min. In some embodiments, the second ultrasonic treatment is conducted at an ultrasonic frequency of 20 kHz to 60 kHz, and preferably 25 kHz to 55 kHz. In some embodiments, the second ultrasonic treatment is conducted at an ultrasonic power of 500 W to 1,500 W, and preferably 600 W to 1,400 W. Controlling the parameters of the second ultrasonic treatment within the above range is more conducive to graphene fully entering the pores of the cemented carbide.

In the present disclosure, the graphene/WC—Co cemented carbide is subjected to second vacuum hot-pressed sintering to obtain the WC cemented carbide with graphene and cobalt gradients reversed with each other.

In some embodiments of the present disclosure, the second vacuum hot-pressed sintering is conducted at a temperature of 1,300° C. to 1,500° C., and preferably 1,350° C. to 1,450° C. In some embodiments, the second vacuum hot-pressed sintering is conducted at a pressure of 5 MPa to 40 MPa, and preferably 10 MPa to 30 MPa. Controlling the parameters of the second vacuum hot-pressed sintering within the above range could provide sufficient driving force for the migration of Co, while making the structure of the cemented carbide denser and preventing the abnormal growth of tungsten carbide grains.

The WC cemented carbide with graphene and cobalt gradients reversed with each other prepared by the method according to the present disclosure has high hardness, great wear resistance, and high toughness. Moreover, the method is simple and efficient, and does not form other undesirable defects during induced cobalt migration.

The present disclosure further provides a WC cemented carbide with graphene and cobalt gradients reversed with each other prepared by the method.

In some embodiments of the present disclosure, the WC cemented carbide with graphene and cobalt gradients reversed with each other includes a surface layer, an intermediate layer, and a core in sequence from outside to inside.

In some embodiments of the present disclosure, in the WC cemented carbide with graphene and cobalt gradients reversed with each other, graphene is gradiently distributed with a gradually decreased content from the surface layer to the intermediate layer; in the WC cemented carbide with graphene and cobalt gradients reversed with each other, Co is gradiently distributed with a gradually increased content from the surface layer to the intermediate layer. While using graphene for toughening, the graphene in the surface layer is also used to quickly and fully induce Co to migrate inward, forming a gradient distribution with a gradually increased content from the surface layer to the intermediate layer, thereby resulting in that the WC cemented carbide has high hardness, great wear resistance, and meanwhile high toughness.

In some embodiments of the present disclosure, the core is a homogeneous WC—Co cemented carbide.

In the present disclosure, the WC cemented carbide with graphene and cobalt gradients reversed with each other prepared by the method has high hardness, great wear resistance, and meanwhile high toughness, and thus has broader application prospect.

The technical solutions of the present disclosure will be clearly and completely described below in conjunction with the examples of the present disclosure. Apparently, the described examples are merely a part rather than all of the examples of the present disclosure. All other examples obtained by those skilled in the art based on the examples of the present disclosure without creative efforts shall fall within the scope of the present disclosure.

Example 1

A WC cemented carbide with graphene and cobalt gradients reversed with each other was prepared by a method below, which was performed according to the following procedures:

(1) A WC—Co cemented carbide powder was subjected to first vacuum hot-pressed sintering to obtain a prefabricated WC—Co cemented carbide. Specifically, 40 g of the WC—Co cemented carbide powder (a mass percentage of Co therein being 11%) with a particle size of 1 μm was placed in a graphite mold with a diameter of 24 mm and subjected to the first vacuum hot-pressed sintering at 850° C. and 20 MPa for 60 min.

(2) The prefabricated WC—Co cemented carbide obtained in step (1) was subjected to first ultrasonic treatment and second ultrasonic treatment in sequence to obtain a graphene/WC—Co cemented carbide. Specifically, the first ultrasonic treatment was conducted in anhydrous ethanol at an ultrasonic frequency of 30 kHz and an ultrasonic power of 500 W for 40 min; and the second ultrasonic treatment was conducted in a graphene dispersion (obtained by ultrasonic dispersion of a surfactant (PVP), graphene, and a solvent anhydrous ethanol, the graphene concentration therein being 0.1 g/mL, and a mass ratio of the surfactant to the graphene being 1:1) at an ultrasonic frequency of 30 kHz and an ultrasonic power of 500 W for 2 min.

(3) The graphene/WC—Co cemented carbide obtained in step (2) was subjected to second vacuum hot-pressed sintering at 1,420° C. and 20 MPa for 90 min, to obtain the WC—Co cemented carbide with graphene-induced cobalt gradient distribution (i.e., the WC cemented carbide with graphene and cobalt gradients reversed with each other).

Figure 9A:
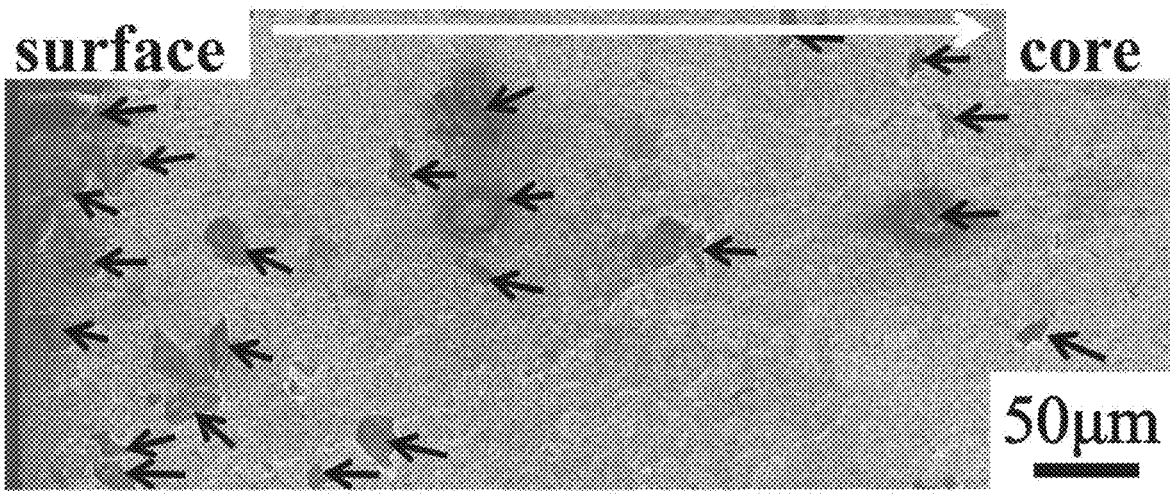
Figure 9B:
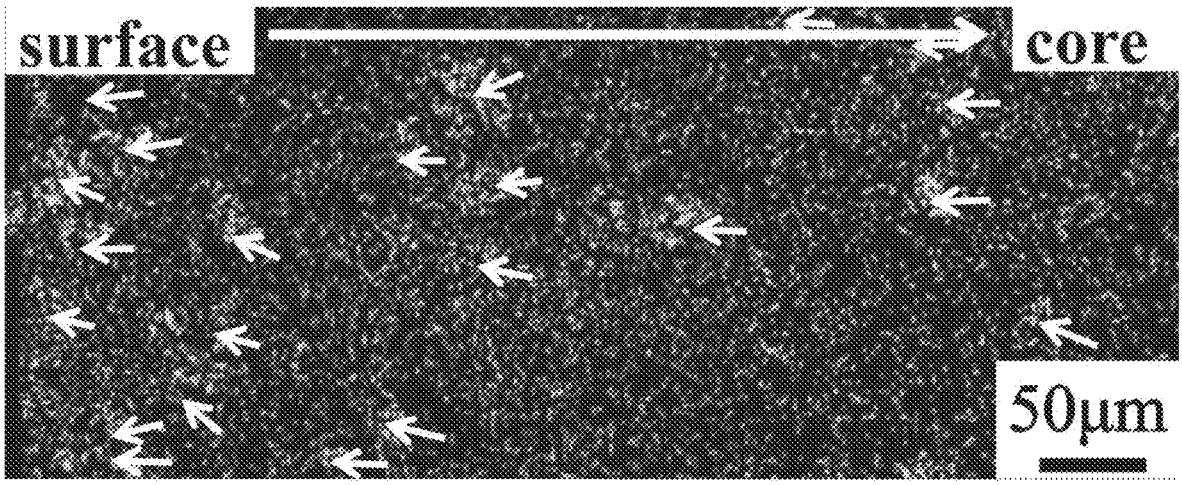

As shown in FIG. 9A, graphene with a certain degree of aggregation (indicated by directional arrows) gradually decreases from the surface to the core of the WC—Co cemented carbide prepared in Example 1. As shown in FIG. 9B, the gradually decreased graphene (indicated by directional arrows) from the surface to the core results in that C element distributed gradually decreases from the surface layer to the core. The WC—Co cemented carbide with graphene-induced cobalt gradient distribution prepared by the above method consisted of a surface layer, an intermediate layer, and a core in sequence from outside to inside, wherein graphene was gradiently distributed with a gradually decreased content from the surface layer to the intermediate layer; Co was gradiently distributed with a gradually increased content from the surface layer to the intermediate layer; and the core was a homogeneous WC—Co cemented carbide.

Example 2

A WC cemented carbide with graphene and cobalt gradients reversed with each other was prepared by a method below, which was performed according to the following procedures:

(1) A WC—Co cemented carbide powder was subjected to first vacuum hot-pressed sintering to obtain a prefabricated WC—Co cemented carbide. Specifically, 40 g of the WC—Co cemented carbide powder (a mass percentage of Co therein being 11%) with a particle size of 1 μm was placed in a graphite mold with a diameter of 24 mm and subjected to the first vacuum hot-pressed sintering at 850° C. and 20 MPa for 60 min.

(2) The prefabricated WC—Co cemented carbide obtained in step (1) was subjected to first ultrasonic treatment and second ultrasonic treatment in sequence to obtain a graphene/WC—Co cemented carbide. Specifically, the first ultrasonic treatment was conducted in anhydrous ethanol at an ultrasonic frequency of 30 kHz and an ultrasonic power of 500 W for 40 min; the second ultrasonic treatment was conducted in a graphene dispersion (obtained by ultrasonic dispersion of a surfactant CTAB, graphene, nano-tungsten carbide (50 nm), and a solvent anhydrous ethanol, a graphene concentration therein being 0.1 g/mL, and a mass ratio of the surfactant to the graphene being 1:1) at an ultrasonic frequency of 30 kHz and an ultrasonic power of 500 W for 2 min.

(3) The graphene/WC—Co cemented carbide obtained in step (2) was subjected to second vacuum hot-pressed sintering at 1,420° C. and 20 MPa for 90 min to obtain the WC—Co cemented carbide with graphene-induced cobalt gradient distribution (i.e., the WC cemented carbide with graphene and cobalt gradients reversed with each other).

The WC—Co cemented carbide with graphene-induced cobalt gradient distribution prepared by the above method included a surface layer, an intermediate layer, and a core in sequence from outside to inside, wherein graphene was gradiently distributed with a gradually decreased content from the surface layer to the intermediate layer; Co was gradiently distributed with a gradually increased content from the surface layer to the intermediate layer; and the core was a homogeneous WC—Co cemented carbide.

Comparative Example 1

40 g of a WC—Co cemented carbide powder (a mass percentage of Co therein being 11%) with a particle size of 1 μm was placed in a graphite mold with a diameter of 24 mm and directly subjected to vacuum hot-pressed sintering at 1,420° C. and 20 MPa for 90 min to obtain a homogeneous WC—Co cemented carbide.

A microscopic appearance of the raw material graphene used in step (1) of Example 1 and Example 2 was collected by SEM. The result is shown in FIG. 1. FIG. 1 shows that the graphene is thin and curled, with a size of about 2 μm.

Figure 2:
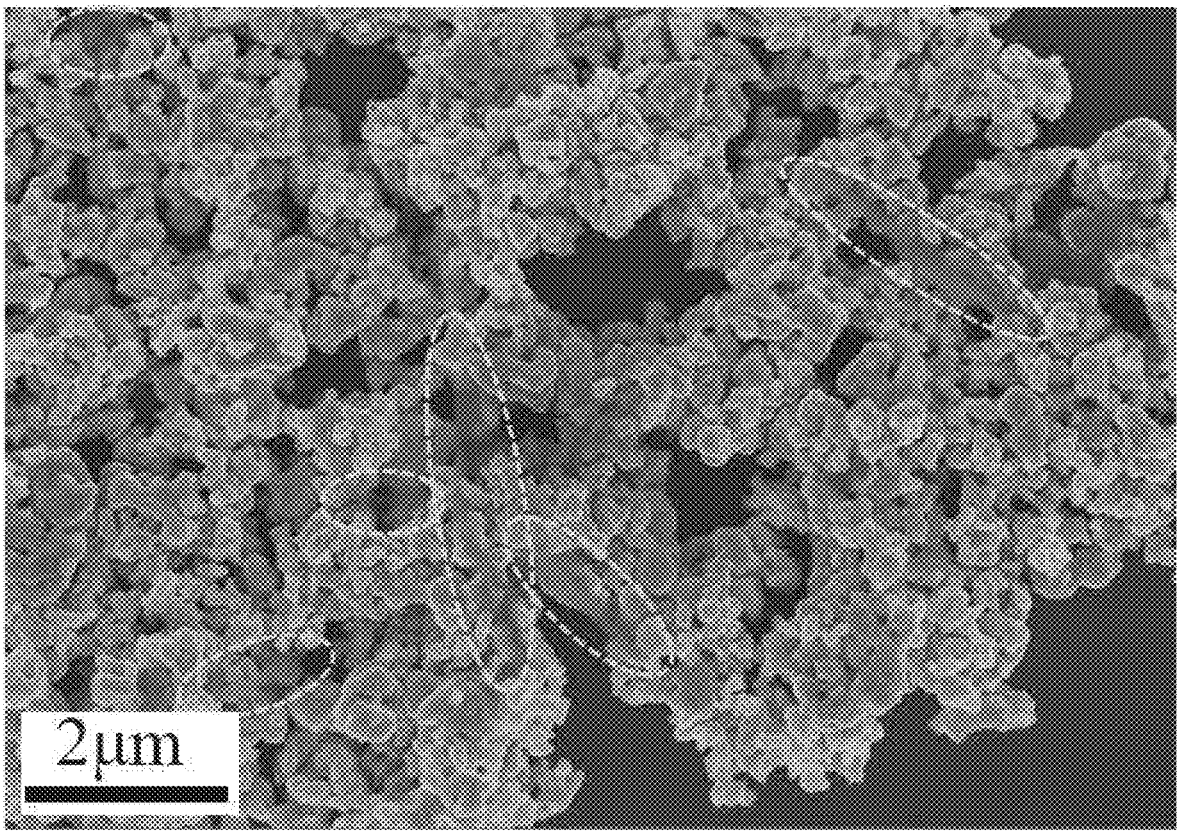
FIG. 2 show an SEM image of the graphene and nanotungsten carbide in a solution for the second ultrasonic treatment prepared in step (2) of Example 2 in the present disclosure.

The microscopic appearances of graphene and nano-tungsten carbide in a solution for the second ultrasonic treatment prepared in step (2) of Example 2 were collected by SEM. The results are shown in FIG. 2. FIG. 2 shows that the nano-tungsten carbide and graphene are adsorbed together, and the graphene adsorbed onto a surface of the nano-tungsten carbide is evenly dispersed and has a stretched appearance without agglomeration.

Figure 3:
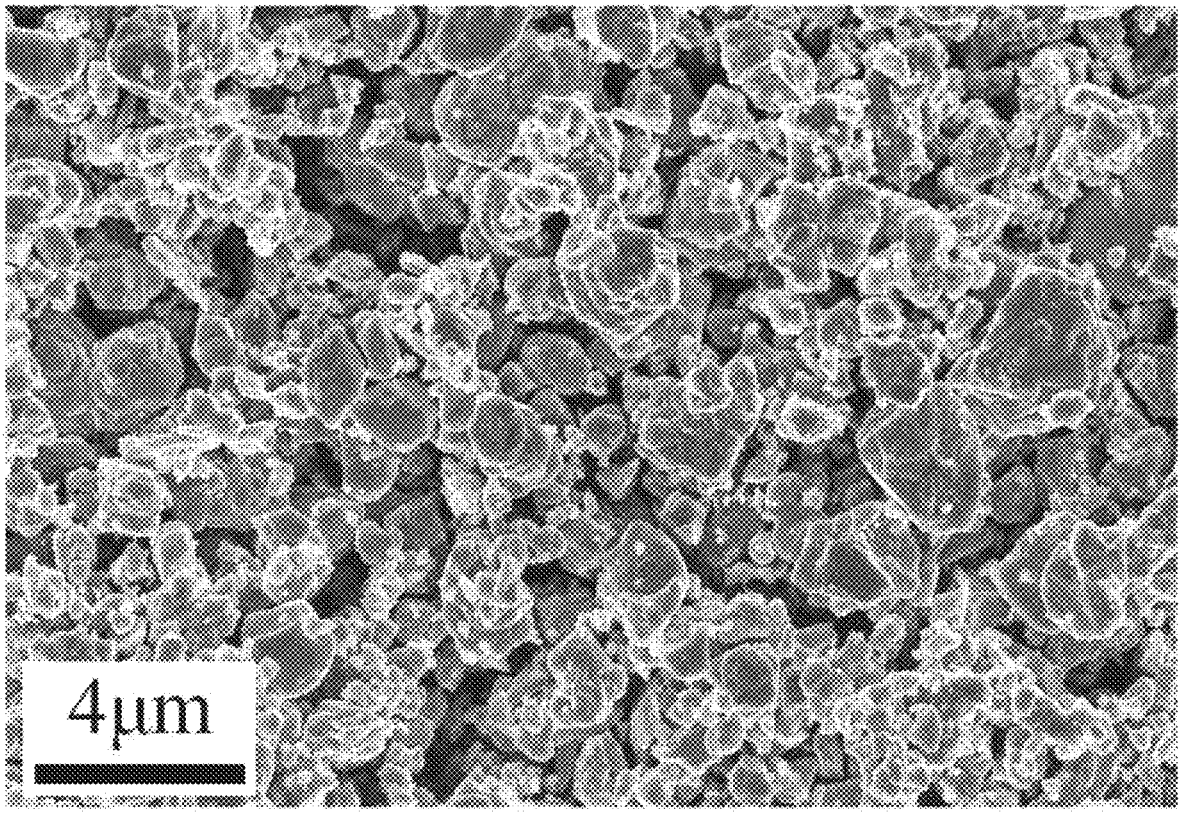
FIG. 3 shows an SEM image of the prefabricated WC—Co cemented carbide in step (1) of Example 1 in the present disclosure.

A microscopic appearance of the prefabricated WC—Co cemented carbide in step (1) of Example 1 was collected by SEM. The results is shown in FIG. 3. FIG. 3 shows that the prefabricated WC—Co cemented carbide has not been sintered to a dense state, and there are a lot of gaps between the particles.

Figure 4:
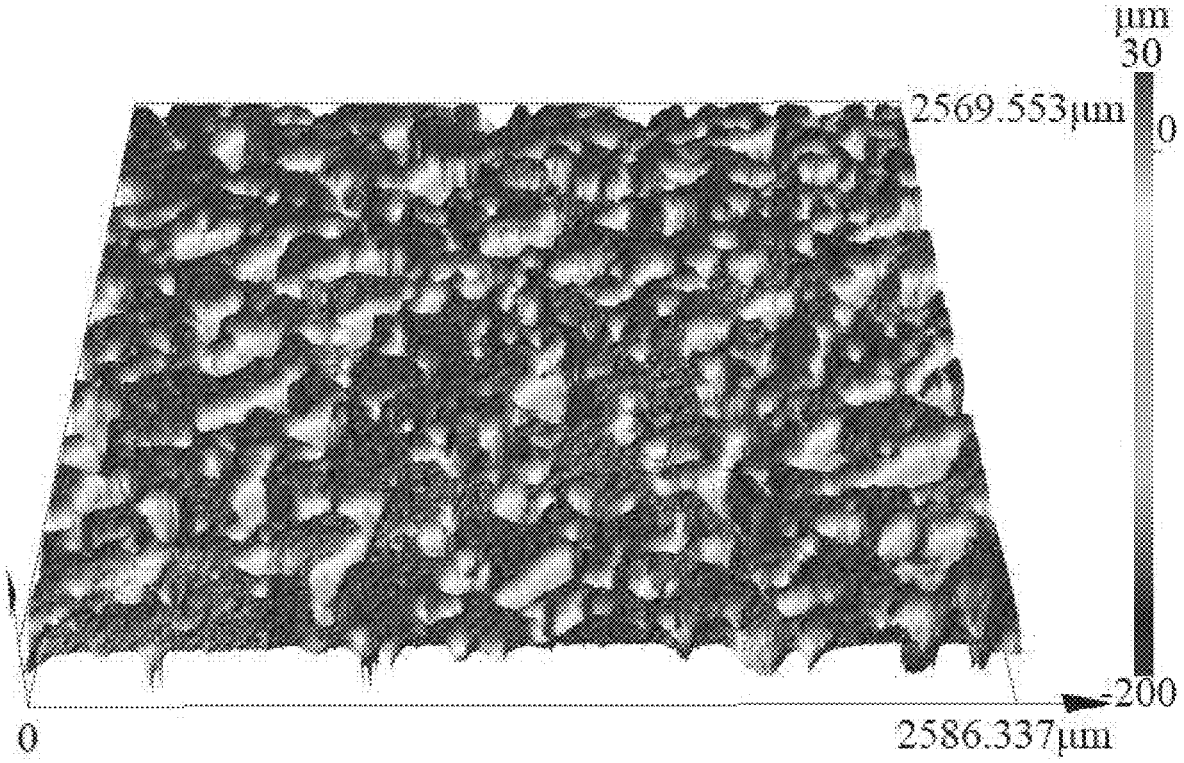
FIG. 4 shows a confocal laser scanning microscopy (CLSM) image of the porous WC—Co cemented carbide after the first ultrasonic treatment in step (2) of Example 1 in the present disclosure.

A microscopic appearance of the porous WC—Co cemented carbide after the first ultrasonic treatment in step (2) of Example 1 was collected by CLSM. The results is shown in FIG. 4. FIG. 4 shows that the raw material particles that have not been sintered to a tight state fall off from the matrix in the action of a shear force generated by bubble bursting during the first ultrasonic treatment, thereby forming a large number of pores.

Figure 5A:
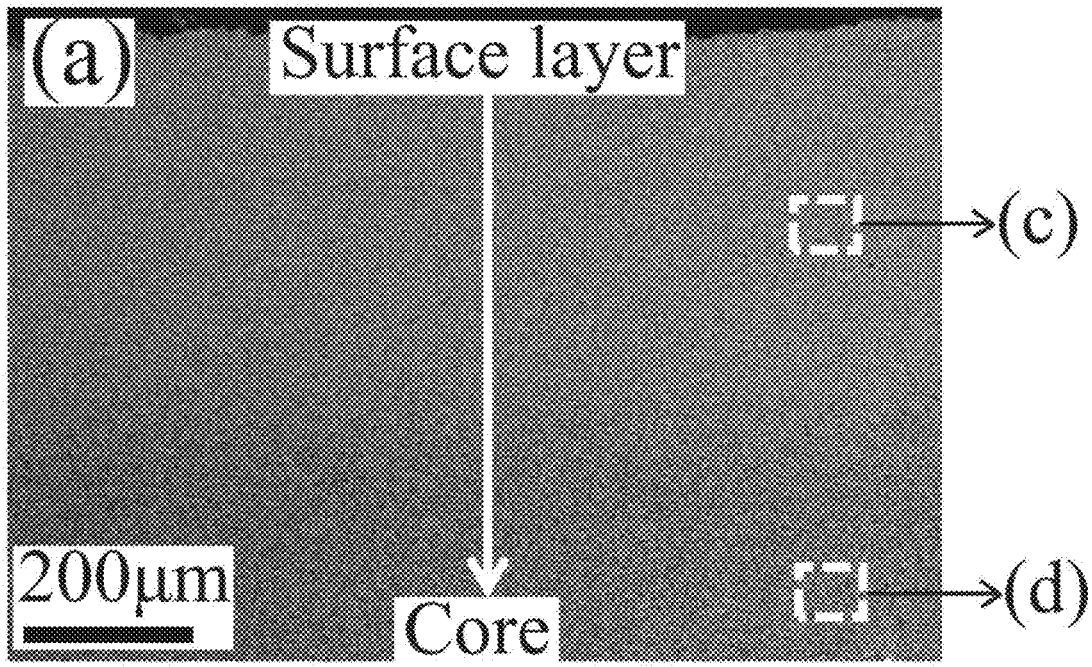
Figure 5B:
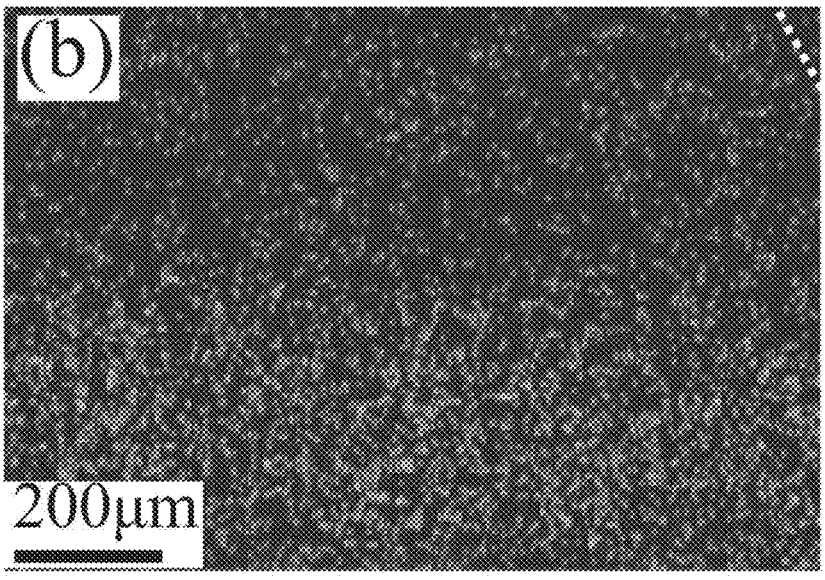
Figure 5C:
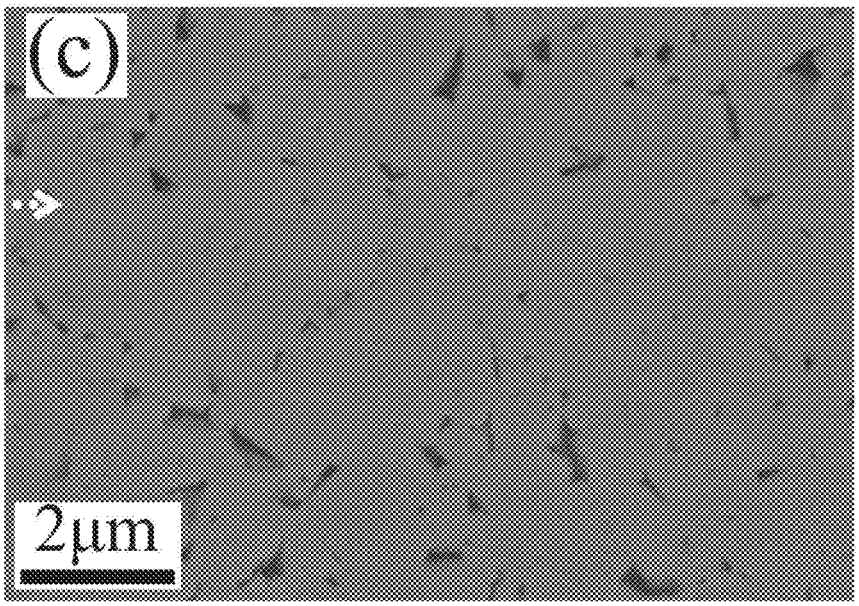
Figure 5D:
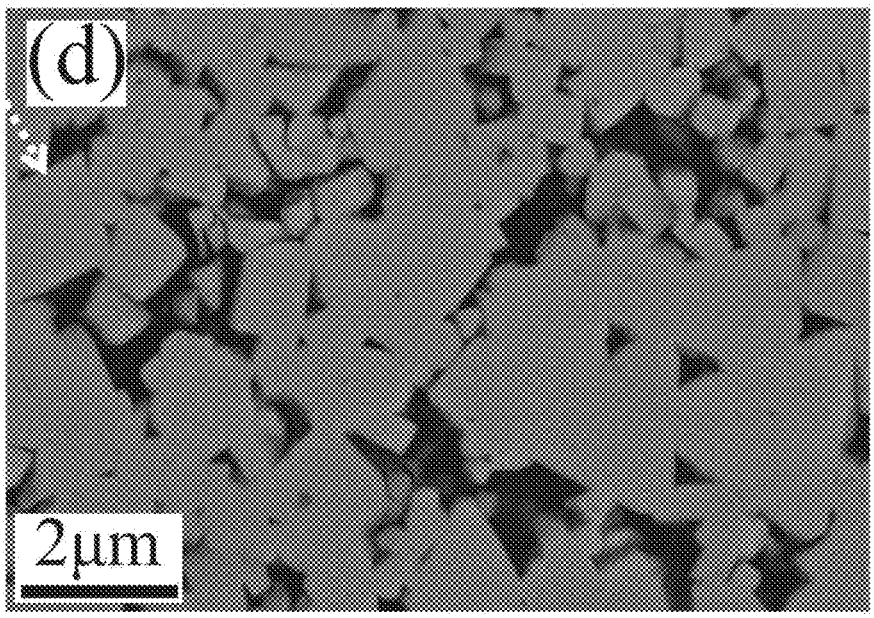
Figure 5E:
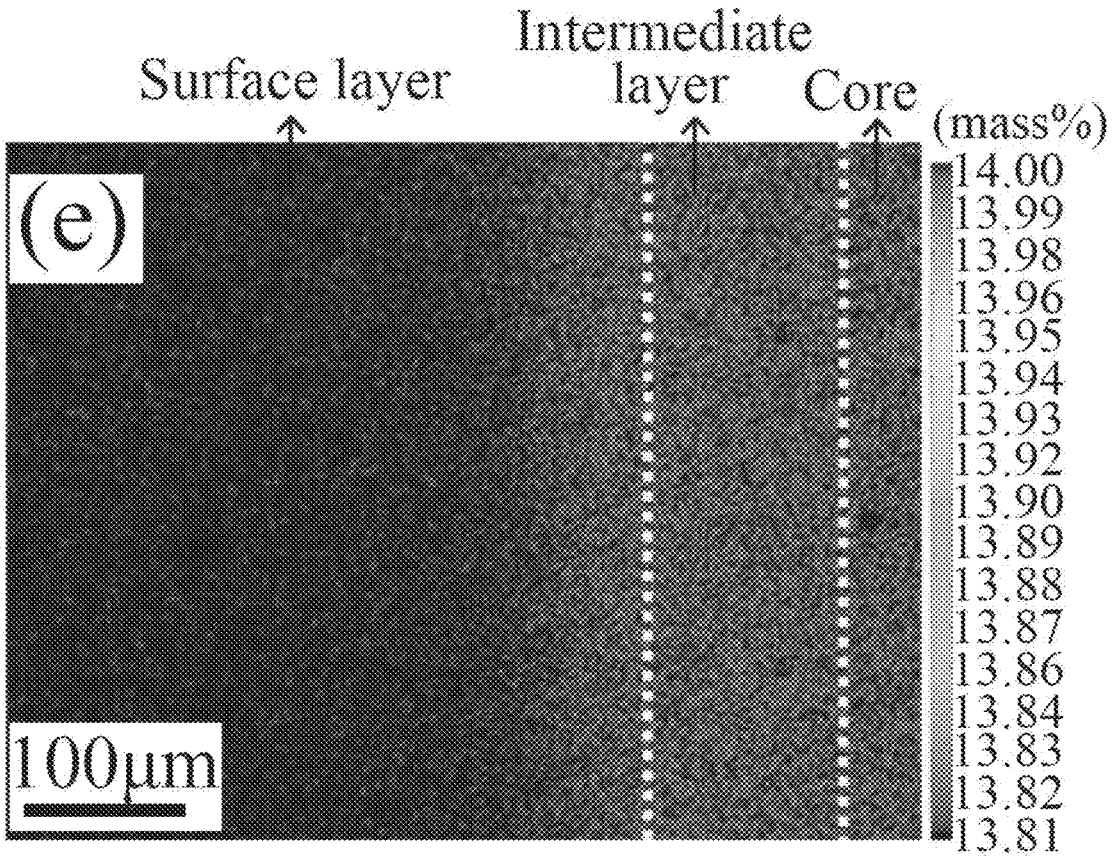
Figure 5F:
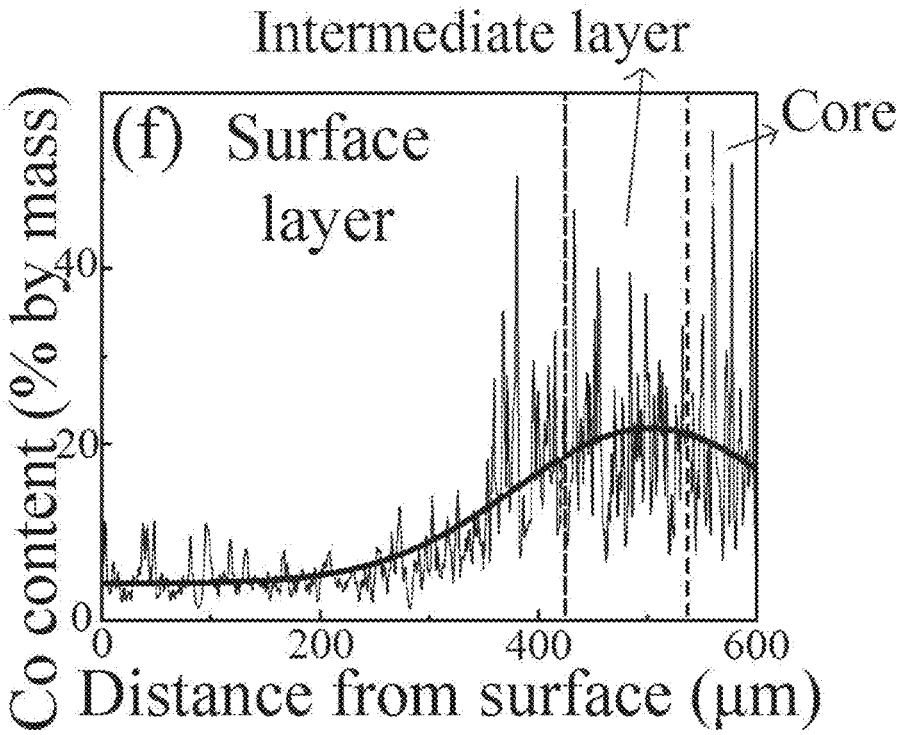

An overall structure morphology, a locally enlarged microscopic appearance, and a corresponding local element distribution diagram of a cross-section of the WC cemented carbide with graphene and cobalt gradients reversed with each other prepared in Example 1 were collected by SEM, X-ray energy spectrometer, and electron probe X-ray microscopic analyzer. The results are shown in FIG. 5A to FIG. 5F, in which, FIG. 5A shows an SEM image of an overall structure of the WC cemented carbide with graphene and cobalt gradients reversed with each other; FIG. 5B shows a cobalt element distribution diagram corresponding to a local area of FIG. 5A, acquired by X-ray energy spectrometer; FIG. 5C and FIG. 5D shows local enlarged SEM images of designated areas in FIG. 5A, respectively; FIG. 5E shows a cobalt element distribution diagram from the surface layer to the core, acquired by electron probe X-ray microscopic analyzer; and FIG. 5F shows a line-scanning image of the cobalt element from the surface layer to the core of FIG. 5E, acquired by electron probe X-ray microscopic analyzer.

As shown in FIG. 5A to FIG. 5F, the overall microstructure of a cross-section of the WC cemented carbide with graphene and cobalt gradients reversed with each other in Example 1 is shown in FIG. 5A. Due to the large difference in the atomic numbers of the WC phase and the cobalt phase, they are presented in different colors in the back scattered electron mode, among which, the light-colored phase is WC and the dark-colored phase is the cobalt phase. From FIG. 5A, it can also be seen that there are more light-colored phases in the surface layer and more dark-colored phases in the intermediate layer, indicating that Co of the surface layer is migrated to achieve a gradient distribution of Co. FIG. 5B shows the distribution of cobalt elements, FIG. 5C shows that the pores in the surface layer are filled with graphene, and FIG. 5D shows that the pores in the core are not filled, indicating that Co and graphene have not reached the core and the core is still a homogeneous WC—Co cemented carbide. Also, in combination with FIG. 5E and FIG. 5F, it can be concluded that: the surface layer has a high WC content and a low cobalt content; the core area has a lower WC content than that of the surface layer, and a higher cobalt content than that of the surface layer; and an interface between the WC grains in the surface layer is not obvious, but there is no obvious change in grain size.

Figure 6A:
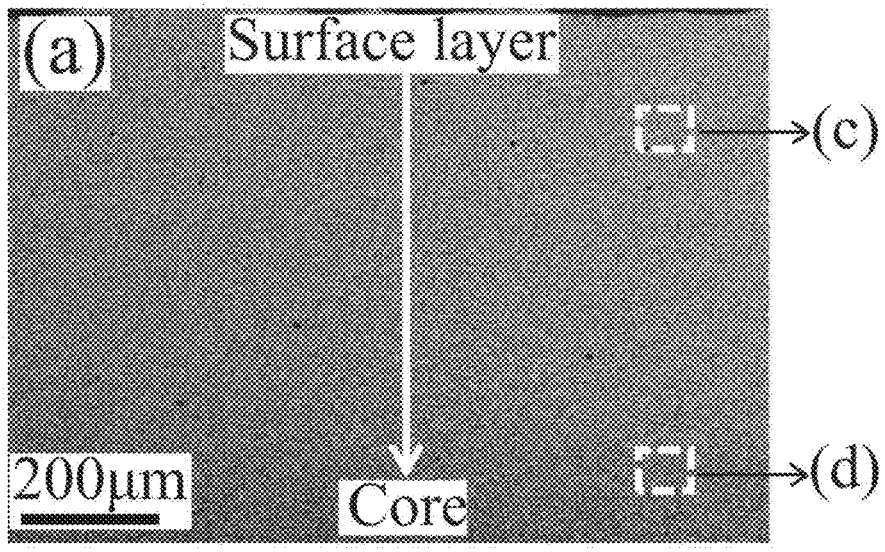
Figure 6B:
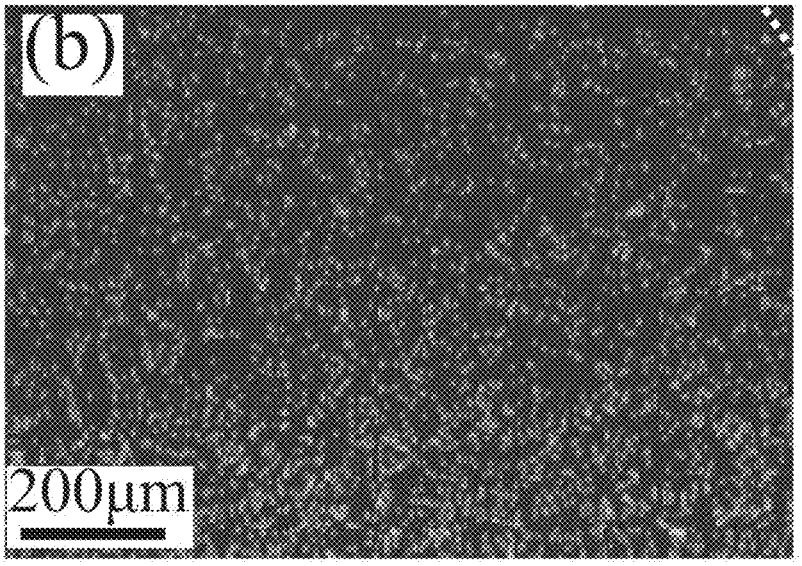
Figure 6C:
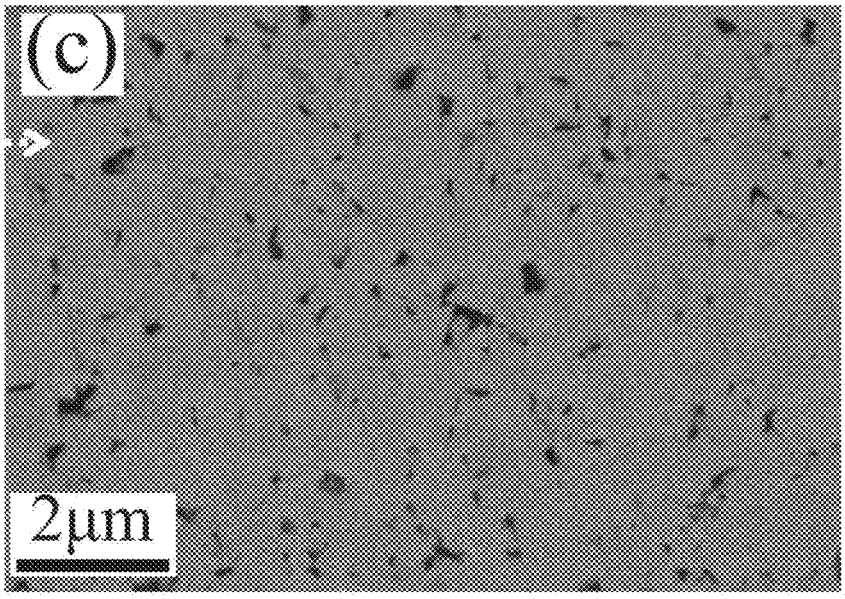
Figure 6D:
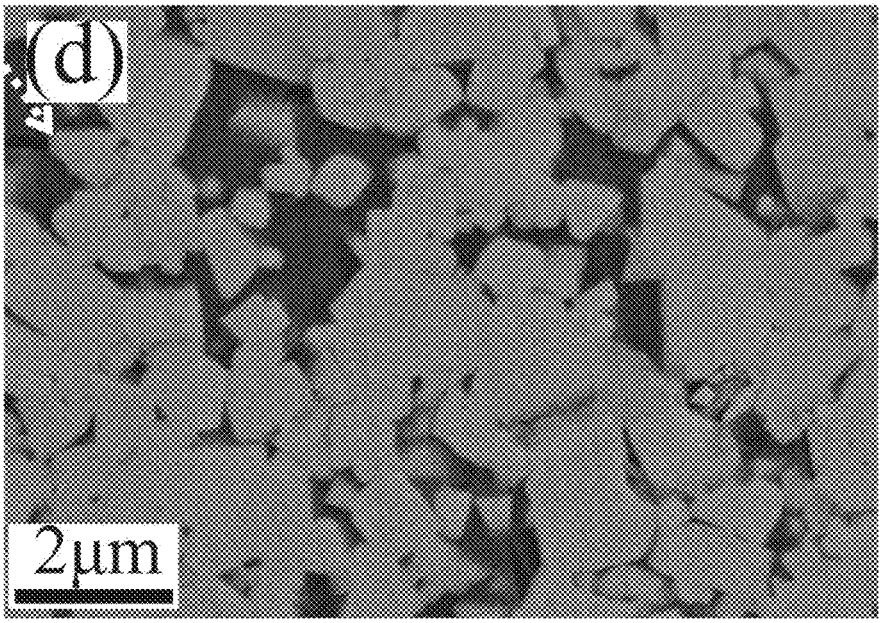

An overall structure morphology, a locally enlarged microscopic appearance, and a corresponding local element distribution of a cross-section of the WC cemented carbide with graphene and cobalt gradients reversed with each other prepared in Example 2 were collected by SEM, X-ray energy spectrometer, and electron probe X-ray microscopic analyzer. The results are shown in FIG. 6A to FIG. 6D, in which, FIG. 6A shows an SEM image of an overall structure of the WC cemented carbide with graphene and cobalt gradients reversed with each other; FIG. 6B shows the cobalt element distribution corresponding to a local area of FIG. 6A; FIG. 6C and FIG. 6D show local enlarged SEM images of designated areas in FIG. 6A, respectively.

In FIG. 6A to FIG. 6D, FIG. 6A and FIG. 6B show similar features to FIG. 5A and FIG. 5B, and the cobalt content is gradiently distributed. Comparing FIG. 6C and FIG. 6D with FIG. 5C and FIG. 5D, it is shown that after replacing graphene with nano-tungsten carbide-adsorbed graphene, the grain size in the area shown in FIG. 6C is significantly smaller than those in FIG. 5C and FIG. 6D. Moreover, the interface between the grains is unclear due to the low cobalt content in the dark phase.

Figure 7A:
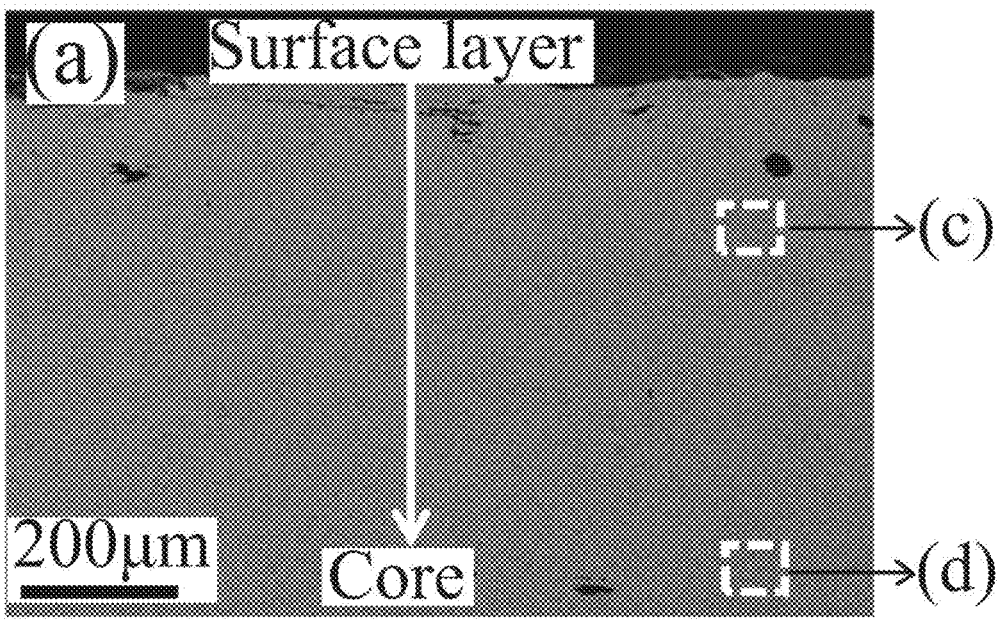
Figure 7B:
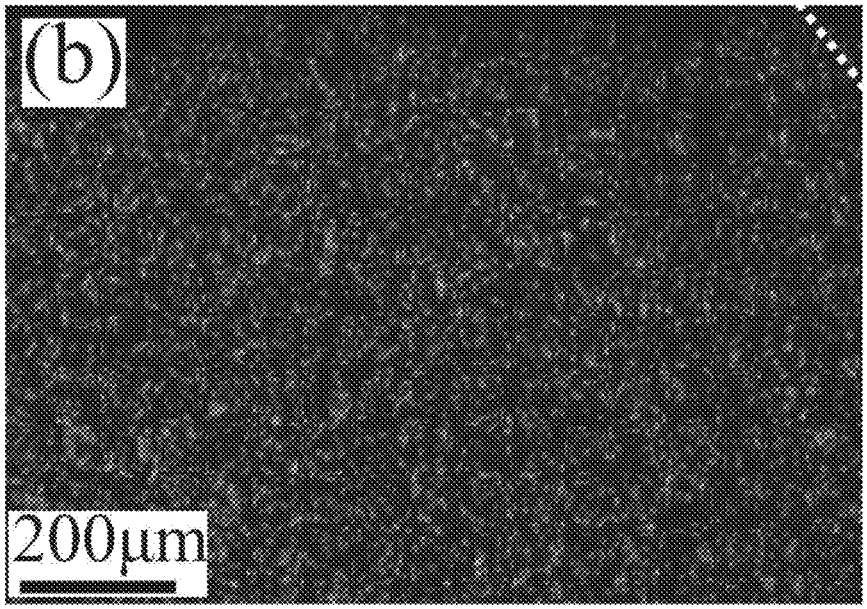
Figure 7C:
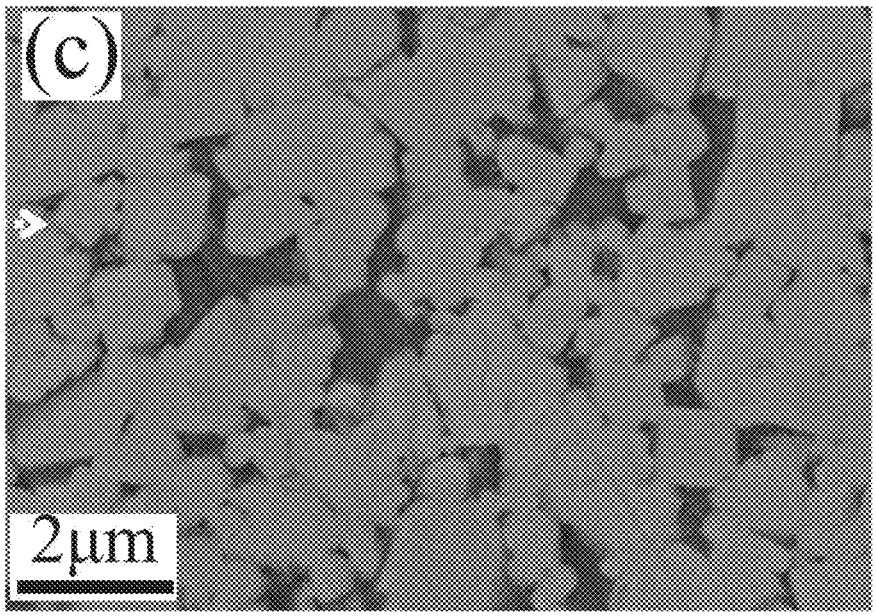
Figure 7D:
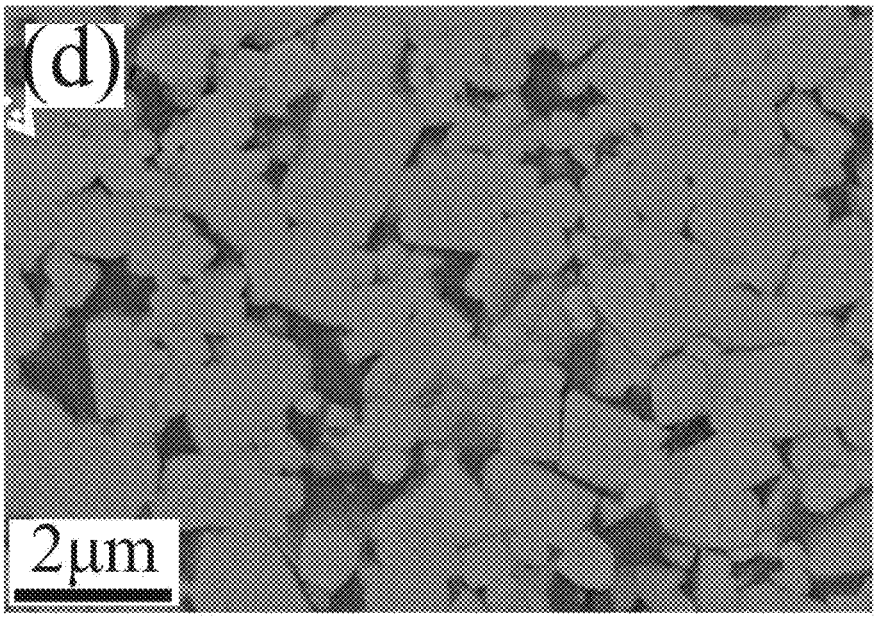

An overall structure morphology, a locally enlarged microscopic appearance, and a corresponding local element distribution of the homogeneous cemented carbide prepared in Comparative Example 1 were collected by SEM and X-ray energy spectrometer. The results are shown in FIG. 7A to FIG. 7D, in which FIG. 7A shows an SEM image of an overall structure of the homogeneous cemented carbide; FIG. 7B shows a cobalt element distribution diagram corresponding to a local area of FIG. 7A; FIG. 7C and FIG. 7D show local enlarged SEM images of designated areas in FIG. 7A, respectively.

As shown in FIG. 7A to FIG. 7D, the homogeneous cemented carbide of Comparative Example 1 has no composition gradient and no color change from the surface layer to the core. From the microscopic appearances of the surface layer and core in FIG. 7C and FIG. 7D, there is no obvious change in grain size and the cobalt phase is evenly distributed.

A hardness test was conducted using a HV-50Z (Shanghai Shangcai Testermachine Co., Ltd., China) hardness tester with a pressure of 30 kg for 15 s, and the fracture toughness was calculated according to Equation (i). A friction and wear test was conducted using a high-speed reciprocating friction and wear tester (HSR-2M) with a pressure of 80 N for 30 min, and the friction coefficient was automatically recorded by the tester. The 3D morphology of the wear scar was observed using an LSCM instrument (LSCM, OLS-5000), a cross-sectional area of the wear scar was measured, and the wear rate was calculated according to Equation (ii).

$$K_{IC} = 0.0028(HP/L)^{1/2}; \quad \text{Equation (i)}$$

where $K_{IC}$ represents a fracture toughness, H represents an indentation hardness, P represents a load, and L represents a total crack length.

$$W = LS/Fvt; \quad \text{Equation (ii)}$$

where

W represents a wear rate, L represents a wear scar length, S represents a wear scar cross-sectional area, F represents a pressure, v represents a wear velocity, and t represents a wear time.

Figure 8:
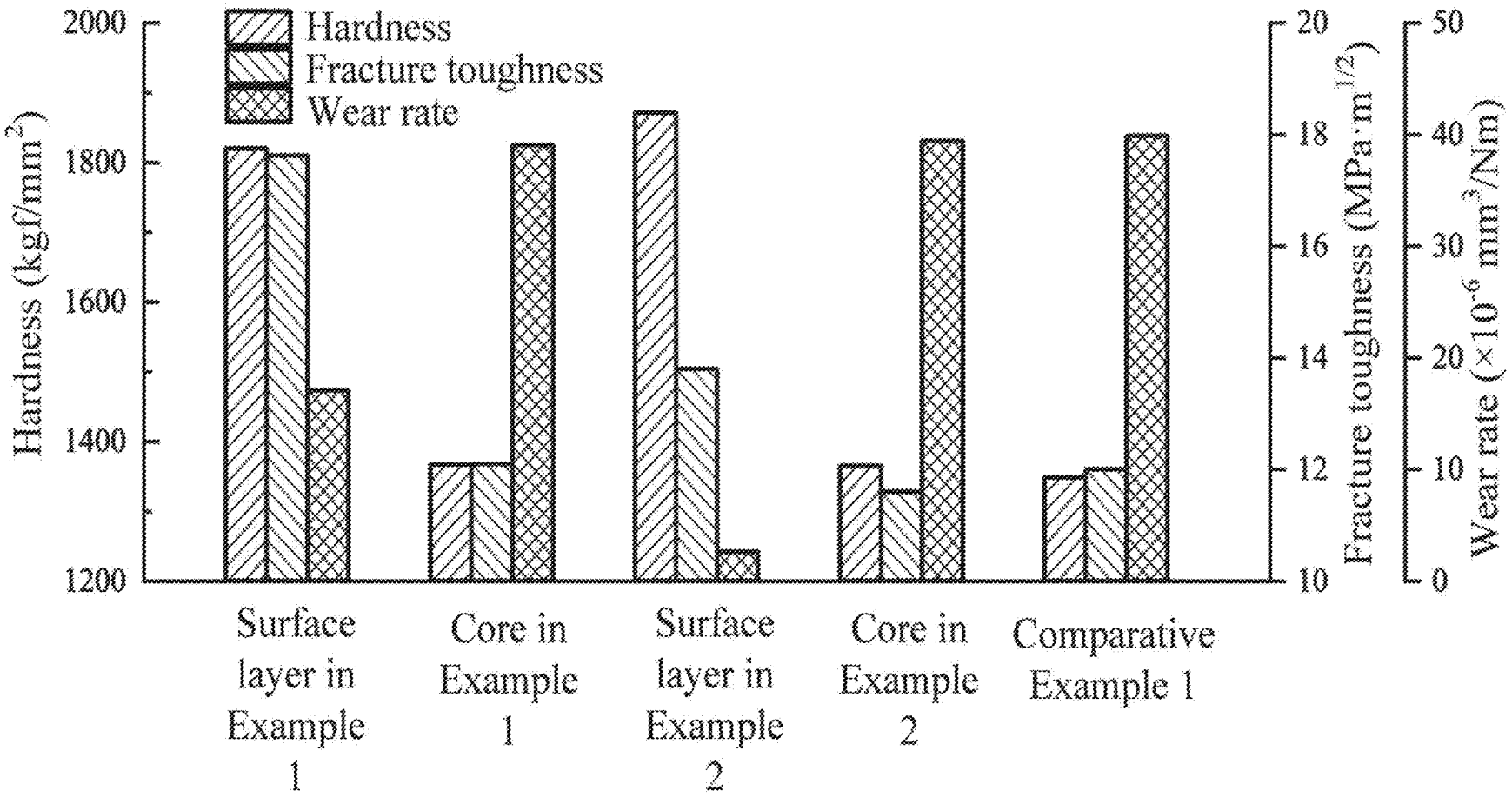
FIG. 8 shows a histogram illustrating the hardness, fracture toughness, and wear rate in Examples 1 to 2 and Comparative Example 1 of the present disclosure.

The hardness test results, as well as the calculation results of fracture toughness and wear rate in Example 1, Example 2, and Comparative Example 1 are shown in FIG. 8 and Table 1.

TABLE 1

Hardness test results as well as calculation results of fracture toughness and wear rate in Example 1, Example 2, and Comparative Example 1

| | | Example 1 | Example 2 | Comparative Example 1 |
|---|---|---|---|---|
| Surface layer | Hardness (kgf/mm$^2$) | 1820 | 1871 | Hardness of 1,349 kgf/mm$^2$; fracture toughness of 12 MPa · m$^{1/2}$; Wear rate of $39.86 \times 10^{-6}$ mm$^3$/Nm |
| | Fracture toughness (MPa · m$^{1/2}$) | 17.6 | 13.8 | |
| | Wear rate (mm$^3$/Nm) | $17.1 \times 10^{-6}$ | $2.62 \times 10^{-6}$ | |
| Core | Hardness (kgf/mm$^2$) | 1367 | 1365 | |
| | Fracture toughness (MPa · m$^{1/2}$) | 12.1 | 11.6 | |
| | Wear rate (mm$^3$/Nm) | $39.06 \times 10^{-6}$ | $39.45 \times 10^{-6}$ | |

As shown in Table 1 and FIG. 8, the WC cemented carbide with graphene and cobalt gradients reversed with each other prepared by the method according to the present disclosure has a hardness of (1,820-1,871) kgf/mm$^2$, a fracture toughness of (13.8-17.6) MPa·m$^{1/2}$, and a wear rate of ($2.62\times10^{-6}$-$17.1\times10^{-6}$) mm$^3$/Nm in the surface layer; a hardness of (1,365-1,367) kgf/mm$^2$, a fracture toughness of (11.6-12.1) MPa·m$^{1/2}$, and a wear rate of ($39.06\times10^{-6}$-$39.45\times10^{-6}$) mm$^3$/Nm in the core. Compared with the homogeneous WC—Co cemented carbide in Comparative Example 1, the WC cemented carbide with graphene and cobalt gradients reversed with each other has the surface hardness increased by 34.9% to 38.7%, the surface fracture toughness increased by 15% to 46.6%, and the surface wear rate reduced by 57% to 93.4%; and meanwhile has equivalent core performance to that of Comparative Example 1, due to the core of both being the homogeneous WC-11% Co cemented carbide.

In summary, the method according to the present disclosure allows that the prepared WC cemented carbide with graphene and cobalt gradients reversed with each other has high hardness, great wear resistance, and high toughness, and does not cause abnormal growth of tungsten carbide grains or the formation of other defects.

The above descriptions are merely preferred embodiments of the present disclosure. It should be noted that a person of ordinary skill in the art may further make several improvements and modifications without departing from the principle of the present disclosure, but such improvements and modifications should be deemed as falling within the scope of the present disclosure.

What is claimed is:

1. A method for preparing a cemented carbide with dual gradients by graphene-induced Co migration, comprising the steps of (1) subjecting a WC—Co cemented carbide powder to first vacuum hot-pressed sintering to obtain a prefabricated WC—Co cemented carbide;

(2) subjecting the prefabricated WC—Co cemented carbide obtained in step (1) to first ultrasonic treatment and second ultrasonic treatment in sequence to obtain a graphene/WC—Co cemented carbide, wherein the first ultrasonic treatment is conducted in anhydrous ethanol, and the second ultrasonic treatment is conducted in a graphene dispersion; and (3) subjecting the graphene/WC—Co cemented carbide obtained in step (2) to second vacuum hot-pressed sintering to obtain the cemented carbide with dual gradients.

2. The method as claimed in claim 1, wherein in step (2), the first ultrasonic treatment is conducted at an ultrasonic frequency of 20 kHz to 60 kHz and an ultrasonic power of 500 W to 1,500 W for 1 min to 90 min.

3. The method as claimed in claim 1, wherein in step (2), the second ultrasonic treatment is conducted at an ultrasonic frequency of 20 kHz to 60 kHz and an ultrasonic power of 500 W to 1,500 W for 30 s to 60 min.

4. The method as claimed in claim 1, wherein in step (2), the graphene dispersion has a graphene concentration of 0.1 g/mL to 1 g/mL.

5. The method as claimed in claim 1, wherein in step (1), the first vacuum hot-pressed sintering is conducted at a temperature of 500° C. to 1,200° C. and a pressure of 5 MPa to 40 MPa.

6. The method as claimed in claim 1, wherein in step (1), a mass percentage of Co in the WC—Co cemented carbide powder ranges from 4% to 20%.

7. The method as claimed in claim 6, wherein in step (1), the WC—Co cemented carbide powder has a particle size of 0.1 μm to 20 μm.

8. The method as claimed in claim 1, wherein in step (1), the WC—Co cemented carbide powder has a particle size of 0.1 μm to 20 μm.

9. The method as claimed in claim 1, wherein in step (3), the second vacuum hot-pressed sintering is conducted at a temperature of 1,300° C. to 1,500° C. and a pressure of 5 MPa to 40 MPa.

* * * * *